United States Patent [19]

Bornancini

[11] Patent Number: 4,539,770

[45] Date of Patent: Sep. 10, 1985

[54] PRESSABLE LATCH FOR SEMIAUTOMATIC PISTOL MAGAZINES, ADAPTABLE FOR USE BY LEFT-HANDED PERSONS

[75] Inventor: Jose C. M. Bornancini, Porto Alegre, Brazil

[73] Assignee: Forjas Taurus S.A., Porto Alegre, Brazil

[21] Appl. No.: 502,711

[22] Filed: Jun. 9, 1983

[30] Foreign Application Priority Data

Nov. 19, 1982 [BR] Brazil ..... 6201580

[51] Int. Cl.[3] ..... F41C 25/06

[52] U.S. Cl. ..... 42/7

[58] Field of Search ..... 42/7

[56] References Cited

U.S. PATENT DOCUMENTS 1,133,281 3/1915 Hammond ..... 42/7

1,397,109 11/1921 Pedersen ..... 42/7

4,236,337 12/1980 Beretta ..... 42/7

4,449,311 5/1984 Giragosian ..... 42/7

*Primary Examiner*—Charles T. Jordan

*Attorney, Agent, or Firm*—Emory L. Groff, Jr.

[57] ABSTRACT

A pressable magazine latch for semiautomatic pistols adaptable for use by either right or left-handed persons includes a guide-tube anchored wihtin the pistol frame which contains a displaceable rigidly connected two-part latch member therewithin. A spring normally maintains the latch member engaged with the magazine and presents a latch member button projecting beyond one end face of the guide-tube. Despressing this button substantially flush with the adjacent guide-tube end wall releases the latch from the magazine while further axial displacement of the latch member allows subsequent disassembly of the two latch parts to permit reassembly thereof in a reverse position within the guide-tube.

6 Claims, 9 Drawing Figures

FIG. 1
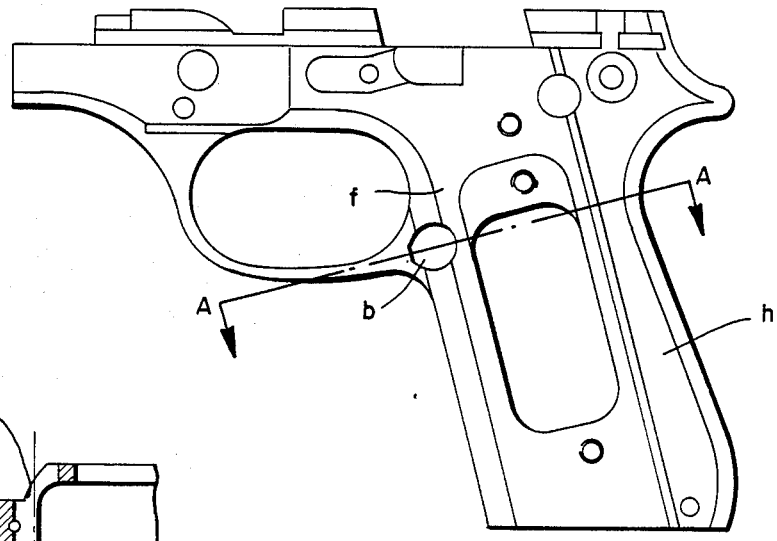
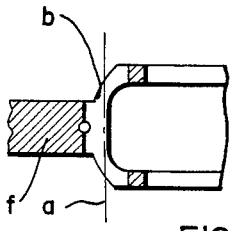
FIG. 1A
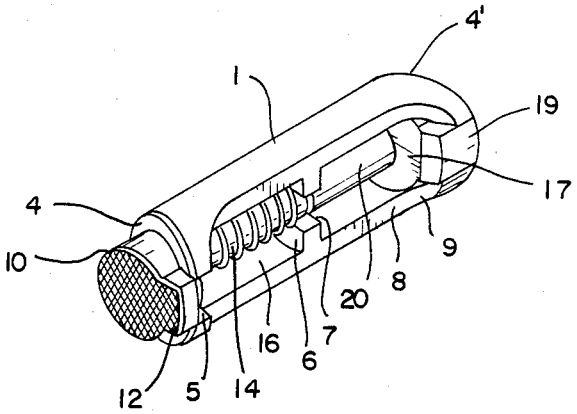
FIG. 2
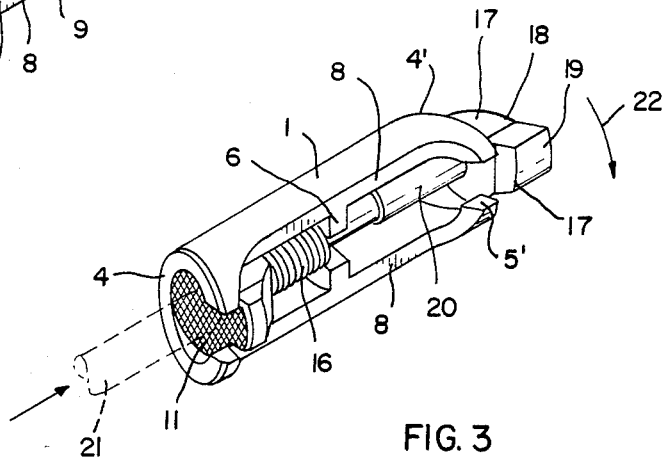
FIG. 3

PRESSABLE LATCH FOR SEMIAUTOMATIC PISTOL MAGAZINES, ADAPTABLE FOR USE BY LEFT-HANDED PERSONS

Since the early successful developments in the field of semiautomatic pistols, pressure-actuated magazine latches comprising a push button on the front of the handle and just behind the trigger, have been well known. This is the ideal position so that the release means can be actuated by pressing the respective button with the thumb of the hand holding the pistol, thus freeing the other hand to allow removal and/or reloading of a new magazine.

The above solution for latching the magazine in semiautomatic pistols has been employed by two of the more famous inventors in this field, namely George Luger and John M. Browning. Examples will be found in the traditional Model 1900–1906 (Luger cal. 7.65 mm), the 1904–1908 (Luger cal. 9 mm) the famous Model Colt-Government M. 1911 (cal. 45 ACP) and in an improvement thereover, the Browning H.P. 1935 (Luger cal. 9 mm).

Numerous pistols employing the type of latch as generally proposed by Luger and Browning have subsequently been produced and include the Russian TOKAREV, the Polish RADOM the French MAS, the American SMITH AND WESSON, etc.

Further variations are exhibited by the Japanese NAMBU (model 1914), the German SAUER (model 1938 in 7.65) and more recently, the Czechoslovakian CZ (models 7.65 and 9 mm) and the Italian BERETTA 92S.

In the referred Beretta model (U.S. Pat. No. 4,236,337) there is disclosed an alternative permitting reversing the disposition of a latch having a large button, in order to enable it to be actuated either by right-handed or left-handed persons.

The enlarged dimension of the latch button of the Luger-Browning release means has been found to be a disadvantage leading to the accidental release of the magazine when the shooter inadvertently presses the button with the tip of the thumb upon excitedly holding the firearm. Furthermore, the mechanism used in the Beretta pistol makes use of a very complex steel member which acts both as the actuation button and as the latch body, this member sliding in a cavity extending completely through an aluminum body thereby dividing the body in a critical zone with respect to the firearm's robustness. The frequently sliding movements of the steel member in relation to the aluminum walls of the cavity, which includes complicated profiles and offers a low guiding surface, results in friction and consequent wear, which is aggravated by the eventual engaging and disengaging stresses employed to reverse the acuation of the release means. This wear prevents close tolerances from being kept, which tolerances are indispensable for a good magazine operation so that the magazine remains fully engaged to assure feeding of the gun.

The object of the present invention is to provide a magazine latch obviating these drawbacks by means of a more reliable and strong mechanism which operates with less complex components, particularly for use in combat pistols which face harder and more difficult conditions of use as found in military and police forces.

Therefore, the system proposed in the present invention is predominantly based on the use of a steel guide-tube which is firmly and permanently anchored in a bore of a Duralumin body, the dimensions of the bore being smaller than those of the Beretta one and the contour thereof being more regular than in the previous model. Thus, there is in the Duralumin body, a bore whose walls are reinforced by the steel guide-tube imbedded therein. It is within this guide-tube that the parts of the latch mechanism slide, therefore in a steel-to-steel contact thus assuring a minimum wear by friction. In this manner, there is achieved a greater reliability and durability of the release means even under hard combat conditions (exposure to mud, sand, etc.).

The two components forming the movable portion of the present release mechanism can be assembled or disassembled by means of a screw thread or bayonet connection after thoroughly tightening (up to the maximum) a serrated latch button so that the guide shoulder of its opposed end is free from a corresponding slot in the guide tube.

In view of this, and without the need of using tools, the two movable members and a respective spring may have the position thereof reversed, thereby permitting the latch button to be actuated even with the left-hand thumb finger when this hand is holding the pistol.

These and other objects and advantages of the present invention will be readily apparent from the following description of an embodiment thereof taken in conjunction with the attached drawings, in which:

FIG. 1 is a side view of the frame or body, showing the position and the cross section of the bore for insertion of the latch mechanism guide-tube;

FIG. 1A is a substantially horizontal cross-section taken along the line A—A′ of FIG. 1;

FIG. 2 is a perspective rear view of the latch mechanism mounted in the respective guide-tube for use of the pistol by a right-handed person;

FIG. 3 is a perspective view showing the procedure of disassembling the mechanism from the guide-tube;

Figure 4:
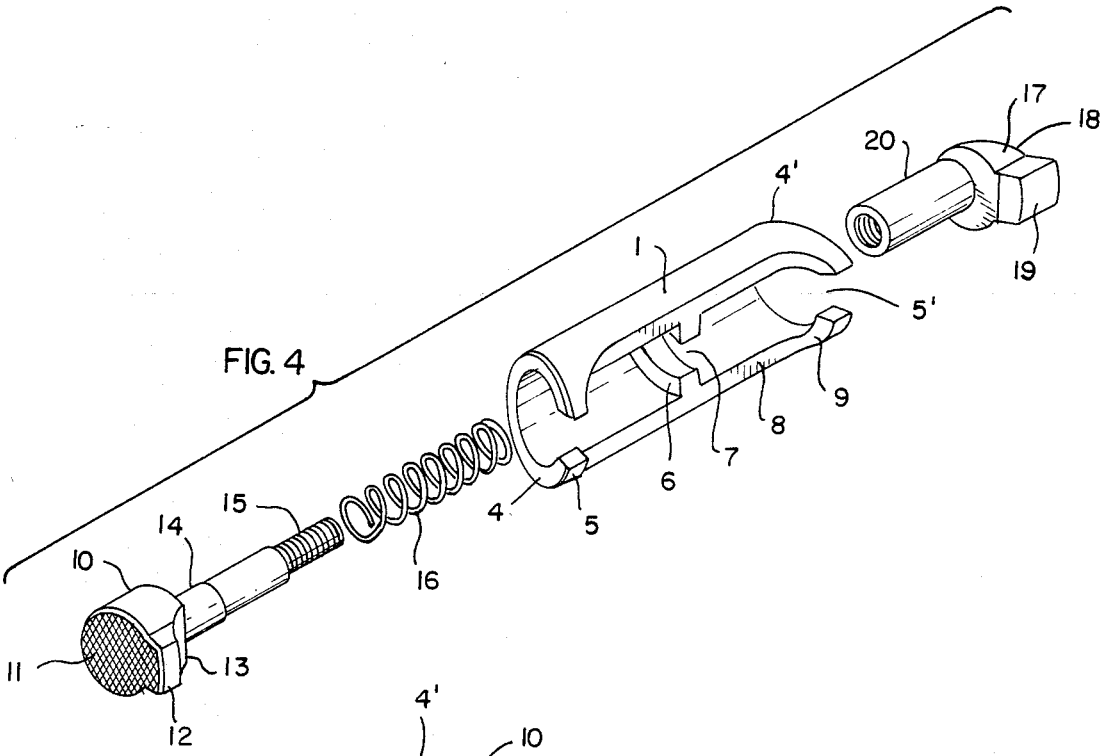
FIG. 4 is an exploded perspective view of the latch mechanism assembly of FIGS. 2 and 3.

The magazine latch system which is the object of the present invention has as the main component thereof a substantially cylindrical steel guide-tube 1 whose outer surface is provided on the front thereof with two flat facets 2—2 forming an angle of 45° with a plane passing through the tube axis a. These flat facets impart to the tube section the same contour as the bore b formed in the pistol frame f, and thereby the position of the guide-tube in relation to the frame is fixed preventing the rotation thereof.

The guide-tube 1 is also axially fixed in the frame bore b by means of an elastic pin 3′ which, upon being inserted in the corresponding frame bore, is housed in a semi-cyclindrical notch 3 in the surface of the steel tube 1. The ends of the steel tube 1 are bounded by the flat faces 4 and 4′, the planes of which converge forwardly of the frame.

The back or rear wall of the tube 1 is cut-away parallel to the axis a thereof, to form rear faces 8—8 whose ends are bent or curved forming the semi-cylindrical surfaces 9—9. Thus, the open back wall of the guide-tube 1 has a contour fitting that of the front face of the magazine 23 which will be tangent thereto, as evident in FIGS. 7 and 8.

The side or end faces 4,4' of the guide-tube are open or cut-away in the rear since the back wall of the tube is also cut by two planes parallel to each other and to the axis thereof thus defining the formation of the two guide notches 5 and 5'.

At the middle of the tube 1, there is a transverse dividing wall or abutment 6 which includes a notch 7 allowing passage of the axle 14 of a displaceable latch member, generally designated L.

The movable portion L of the latch mechanism is formed by two members, namely the actuation button 10 and the latch 17 itself, whose respective cylindrical heads are slidably received within the guide-tube 1. The axle 14 of the button 10 is integrally connected by a thread or bayonet type connection to the tube 20 of the latch 17 itself. The return of the movable portion of the mechanism to the rest portion is achieved by action of a spring 16 mounted on the axle 14.

When, as in FIG. 2, the latch is to be operated by the thumb of the right hand, the cylindrical actuation button 10 has its serrated face 11 thereof protruding from the left end or side face 4 of the guide-tube 1, because the button 10 is pushed outwardly by the spring 16 mounted on the axle 14. This spring will be seen to be compressed between the dividing wall 6 of tube 1 and the planar inner face of the button 10.

The portion of the actuation button 10 which is protruding in relation to the corresponding side face 4 of the guide-tube is determined by the abutment of the end face of tube 20 against the dividing wall 6 of guide-tube 1. Button 10 also includes a rear shoulder 12 the flat faces of which are guided within the corresponding flat faces of the guide notch 5 thus preventing rotation of the button 10 relative to the guide-tube 1. The inwardly directed face of the cylindrical button body 10 adjacent the shoulder 12 defines a curved surface 13.

Figure 5:
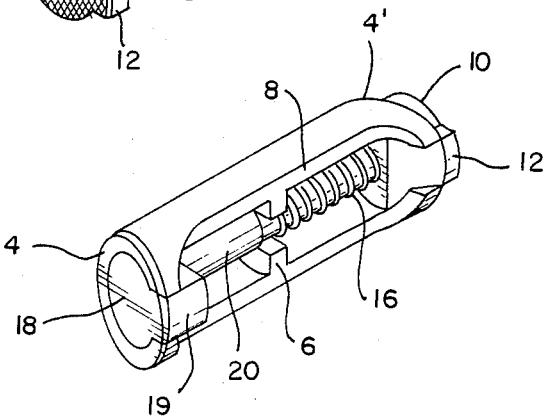
FIG. 5 is a perspective view of the latch mechanism mounted in the respective guide-tube for use of the pistol by left-handed persons.
Figure 6:
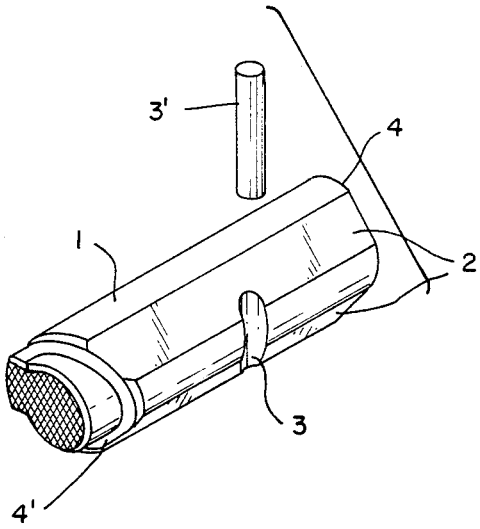
FIG. 6 is a perspective view of the mechanism in the same condition as in FIG. 5, but showing the opposite faceted front portion of the guide-tube.
Figure 7:
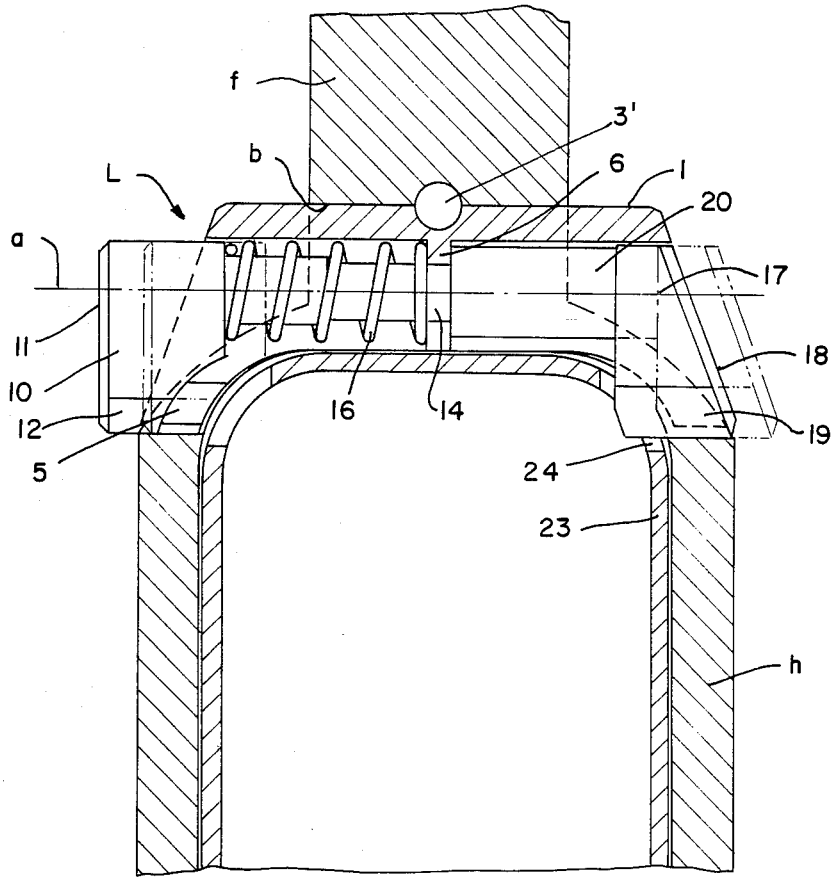
FIG. 7 is an enlarged top view, in partial cross-section, of the pistol handle with the latch mechanism of FIG. 2 installed.
Figure 8:
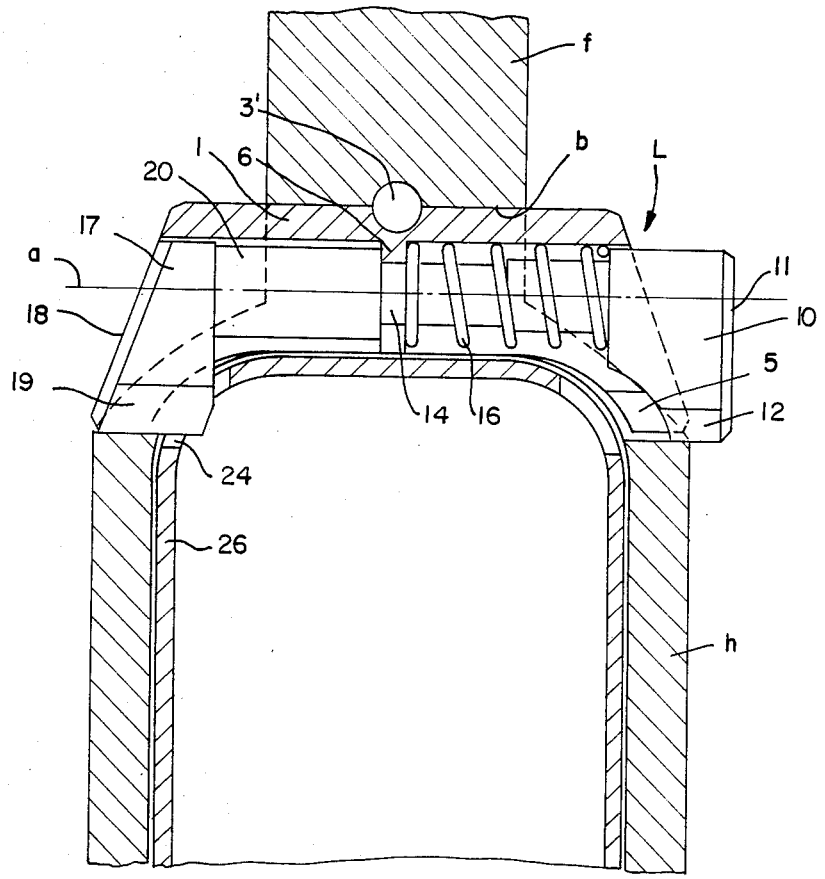
FIG. 8 is a view similar to FIG. 7 with the latch mechanism of FIG. 5 installed.

The latch 17 itself is substantially cylindrically-shaped and is bounded by an outer flat face 18 which, in the rest position of the release means as viewed in FIGS. 5,7 and 8, is arranged as an extension of or flush with the inclined face 4 or 4' of guide-tube 1. This latch 17 also includes a rear shoulder 19 the flat faces of which are guided within the corresponding faces of the guide notch 5 or 5'. This arrangement throughout the normal stroke of the latch 17, prevents rotation thereof and thereby precludes the tube 20 from being separated from the axle 14.

As shown in FIGS. 7 and 8, the latch shoulder 19, due to the action of spring 16, protrudes relative to the inner face of the side wall of the pistol handgrip or handle h, where it engages a slot 24 in the magazine 23 to keep it positioned therein. By pressing the button 10 only enough to compress spring 16 and cause the latch shoulder 19 inner face to become flush with surface 9 of guide-tube 1, the interference of this shoulder with slot 24 of the magazine 23 ceases and the magazine is then expelled by action of its ejection spring.

As is usual in this type of latch, the insertion of the magazine 23 in the pistol handle h, moves the latch shoulder 19 away or outwardly by a camming action until it again engages notch 24 of the magazine 23 due to the action of the return spring 16.

When it is necessary to replace the actuation button 10 towards the right side of the pistol, the mechanism of FIG. 3 is disassembled merely by pressing with any kind of pointed tip 21, the serrated face 11 of button 10 until the shoulder 19 of latch 17 is caused to be free from the guide notch 5' of tube 1. At this point, it is possible to rotate the latch part 17 in the direction of arrow 22, unscrewing its respective tube 20 from the axle 14 of the actuation button part 10, resulting in the disassembly of all movable components of the latch mechanism as seen in FIG. 4.

Further assembly of such components into position as indicated in FIG. 5 results in the actuation button 10 being on the right side of the pistol and then it can be pressed by the thumb of the left hand when a left-handed user holds the firearm.

As it is apparent from the description of the mechanism which is the object of the present invention, the magazine latch has an actuation button with reduced size preventing it from being accidentally pressed and the construction of the latch is simple and wear-proof, permitting of ready reversal of the position of the actuation button for adapting it for use by left-handed persons.

Several modifications and changes of details of the present invention can be made without departing from the scope thereof as claimed in the following claims.

1. A pressable magazine latch for mounting in the frame of semiautomatic pistols and adaptable for use by left-handed persons including, a guide-tube anchored within a bore in the pistol frame behind the trigger, said guide-tube provided with two facets on its front periphery for preventing rotation thereof in said bore, a notch in said guide-tube receiving a pin for preventing withdrawal thereof from said frame bore, said faces bounding said guide-tube and coverging forwardly, said guide-tube cut out at the rear thereof to provide medial flat faces bounded by cylindrical surfaces, the rear of said guide-tube adjacent each said sideface cut away to provide a pair of guide slots, a dividing wall in the interior of said guide-tube forming two halves therein, said dividing wall provided with a rearwardly opening notch, and an axially displaceable latch member disposed within said guide-tube.

2. A pressable magazine latch for semiautomatic pistol magazines according to claim 1 wherein, said displaceably latch member includes an actuation button at one end comprising a cylindrical body having a serrated outer flat face, said cylindrical body further provided with a rear shoulder engaging one of said guide slots in said guide-tube, said shoulder and said cylindrical body having an inwardly directed curved surface, a reduced diameter axle extending inwardly from said cylindrical body and terminating in a tip, said latch member further including a latch having a cylindrical shape bounded by an internal face perpendicular to a tube, a flat outer face on said latch inclined forwardly, a shoulder extending rearwardly from said latch and engaging the other said guide slot of said guide-tube, separable connection means integrally joining said tube and axle with said axle with said axle disposed within said dividing wall notch, and spring means within said guide-tube normally urging said latch member in the direction of said actuation button.

3. A pressable magazine latch for semiautomatic pistol magazines according to claim 2 wherein, said actuation button when mounted on the left side of the pistol is urged by said spring means to protude beyond one of said side faces of said guide-tube with said spring means being in a compressed condition between said button and said dividing wall, said latch tube having a distal portion normally abutting said dividing wall to limit the protrusion of said actuation button, said latch shoulder adapted to engage a notch of a magazine to retain the magazine within the pistol whereby, pressing said actuation button against said spring means displaces said latch shoulder from the notch of the magazine to permit removal of the magazine from the pistol.

4. A pressable magazine latch for semiautomatic pistol magazines according to claim 3 whereby, pressing of said actuation button inwardly beyond the adjacent said guide-tube side face axially displaces said latch member to release said latch shoulder from its said guide-tube slot, thereafter permitting rotation of said latch and tube to actuate said separable connection means and disassemble said latch member components whereafter, said latch member components may be reassembled within said guide-tube with said actuator button and latch disposed adjacent opposite ones of said guide-tube side faces.

5. A pressable magazine latch for semiautomatic pistol magazines according to claim 2, wherein said separable connection means includes cooperating threads on said actuation button axle and said latch tube.

6. A pressable magazine latch for mounting in the frame of semiautomatic pistols and adaptable for use by left-handed persons including, a guide-tube anchored within a bore in the pistol frame behind the trigger, said guide-tube provided with means on its periphery for preventing rotation thereof in said bore, locking means securing said guide-tube against axial withdrawal thereof from said frame bore, side faces bounding said guide-tube and coverging forwardly, said guide-tube cut out at the rear thereof to provide medial flat faces bounded by cylindrical surfaces, the rear of said guide-tube adjacent each said side face cut away to provide a pair of guide slots, a medially disposed dividing wall in the interior of said guide-tube forming two halves therein, said dividing wall provided with an axially extending opening therethrough, and a separable reversible displaceable latch member disposed within said guide-tube.

* * * * *